US007036298B2

(12) United States Patent
Honda

(10) Patent No.: US 7,036,298 B2
(45) **Date of Patent: *May 2, 2006**

(54) ROPE FOR ELEVATOR AND METHOD FOR MANUFACTURING THE ROPE

(75) Inventor: Takenobu Honda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 214 days.

This patent is subject to a terminal disclaimer.

(21) Appl. No.: 10/479,810

(22) PCT Filed: Jun. 27, 2002

(86) PCT No.: PCT/JP02/06503

§ 371 (c)(1),
(2), (4) Date: Dec. 5, 2003

(87) PCT Pub. No.: WO2004/002868

PCT Pub. Date: Jan. 8, 2004

(65) Prior Publication Data

US 2004/0231312 A1 Nov. 25, 2004

(51) Int. Cl.
*D07B 1/00* (2006.01)

(52) U.S. Cl. ..... 57/214; 57/217

(58) Field of Classification Search ..... 57/214, 57/217, 218, 221, 223, 230–232, 237, 241
See application file for complete search history.

(56) References Cited

U.S. PATENT DOCUMENTS

| | | | | |
|---|---|---|---|---|
| 3,800,522 | A * | 4/1974 | Hughes et al. | 57/215 |
| 4,197,695 | A * | 4/1980 | Hughes et al. | 57/7 |
| 4,470,249 | A | 9/1984 | Chiappetta et al. | |
| 4,602,476 | A * | 7/1986 | Riggs et al. | 57/214 |
| 4,606,183 | A * | 8/1986 | Riggs | 57/221 |
| 4,667,462 | A * | 5/1987 | Smyth | 57/217 |
| 4,776,161 | A * | 10/1988 | Sato et al. | 57/223 |
| 5,461,850 | A * | 10/1995 | Bruyneel et al. | 57/212 |
| 5,669,214 | A * | 9/1997 | Kopanakis | 57/218 |
| 5,683,642 | A * | 11/1997 | Muguruma et al. | 264/271.1 |
| 6,164,053 | A * | 12/2000 | O'Donnell et al. | 57/232 |
| 6,276,120 | B1 | 8/2001 | Adriaensen et al. | |
| 6,314,711 | B1 | 11/2001 | De Angelis | |
| 6,321,520 | B1 | 11/2001 | De Angelis | |
| 2004/0026178 | A1 * | 2/2004 | Honda | 187/251 |

FOREIGN PATENT DOCUMENTS

| | | |
|---|---|---|
| DE | 1817678 | 7/1969 |
| EP | 1 273 695 A1 | 1/2003 |
| GB | 1019237 | 2/1966 |
| JP | 55-40233 U | 9/1980 |
| JP | 5-171580 | 7/1993 |
| JP | 10-21751 | 1/1998 |
| JP | 10-140490 | 5/1998 |
| JP | 2003-41493 | 2/2003 |

* cited by examiner

*Primary Examiner*—Shaun R Hurley
(74) *Attorney, Agent, or Firm*—Leydig, Voit & Mayer, Ltd.

(57) ABSTRACT

An elevator rope includes: an inner layer rope; an inner layer covering body of resin and covering the outer periphery of the inner layer rope; an outer layer located in the outer periphery of the inner layer covering body; and an outer layer covering body of a high-friction resin material and covering the outer periphery of the outer layer. The inner layer rope has inner layer strands. The outer layer has outer layer strands and adhesive layers glued to the outer periphery of the outer layer strands. The inner layer strands have exposed portions partially exposed through the outer periphery of the inner layer covering body, with the exposed portions being in direct contact with the outer layer.

14 Claims, 8 Drawing Sheets

ROPE FOR ELEVATOR AND METHOD FOR MANUFACTURING THE ROPE

TECHNICAL FIELD

The present invention relates to an elevator rope to be used in an elevator to suspend a car, and to a method for manufacturing the same.

BACKGROUND ART

Up to now, in an elevator apparatus, to prevent premature wear and breakage of the rope, a sheave having a diameter not less than forty times the rope diameter is used. Thus, to reduce the sheave diameter, it is necessary to reduce the rope diameter, too. However, when the rope diameter is reduced, the car becomes subject to vibration due to fluctuation in the load consisting of baggage and passengers carried in the car, and there is a fear of rope vibration at the sheave being transmitted to the car. Further, since the number of ropes is increased, the construction of the elevator apparatus becomes rather complicated. Further, a reduction in the diameter of the driving sheave results in a reduction in drive frictional force, so that it is necessary to increase the car weight.

DISCLOSURE OF THE INVENTION

The present invention has been made with a view toward solving the above problems in the prior art. It is an object of the present invention to provide an elevator rope which allows a reduction in diameter while maintaining the requisite strength, long service life, and high friction, and a method for manufacturing the same.

An elevator rope according to the present invention includes: an inner layer rope having a plurality of inner layer strands each formed by twisting together a plurality of wires made of steel; an inner layer covering body formed of resin and covering an outer periphery of the inner layer rope; an outer layer provided in an outer periphery of the inner layer covering body and having a plurality of outer layer strands and a plurality of adhesive layers, the outer layer strands being each formed by twisting together a plurality of wires made of steel, the adhesive layers being applied to outer peripheral portions of the outer layer strands; and an outer layer covering body formed of a high-friction resin material and glued to the outer layer strands through the adhesive layers to cover an outer periphery of the outer layer, in which the inner layer strands have a plurality of exposed portions partially exposed through the outer periphery of the inner layer covering body, with the exposed portions being in direct contact with the outer layer.

Further, a method for manufacturing an elevator rope according to the present invention includes: preparing an inner layer rope by twisting together a plurality of inner layer strands each including a plurality of wires made of steel; covering an outer periphery of the inner layer rope with an inner layer covering body formed of a thermoplastic resin; twisting a plurality of outer layer strands each including a plurality of wires made of steel in a direction opposite to a direction in which the inner layer strands are twisted and arranging the plurality of outer layer strands in an outer periphery of the inner layer covering body, and covering an outer periphery of the outer layer with an outer layer covering body formed of a high friction resin material; partially exposing the inner layer strands through an outer periphery of the inner layer strands by applying a tensile force to the inner layer rope and the outer layer strands while heating and softening the inner layer covering body and the outer layer covering body to thereby partially bring the inner layer strands into direct contact with the outer layer; and curing the inner layer covering body and the outer layer covering body.

BEST MODE FOR CARRYING OUT THE INVENTION

Preferred embodiments of the present invention will now be described with reference to the drawings.

Embodiment 1

Figure 1:
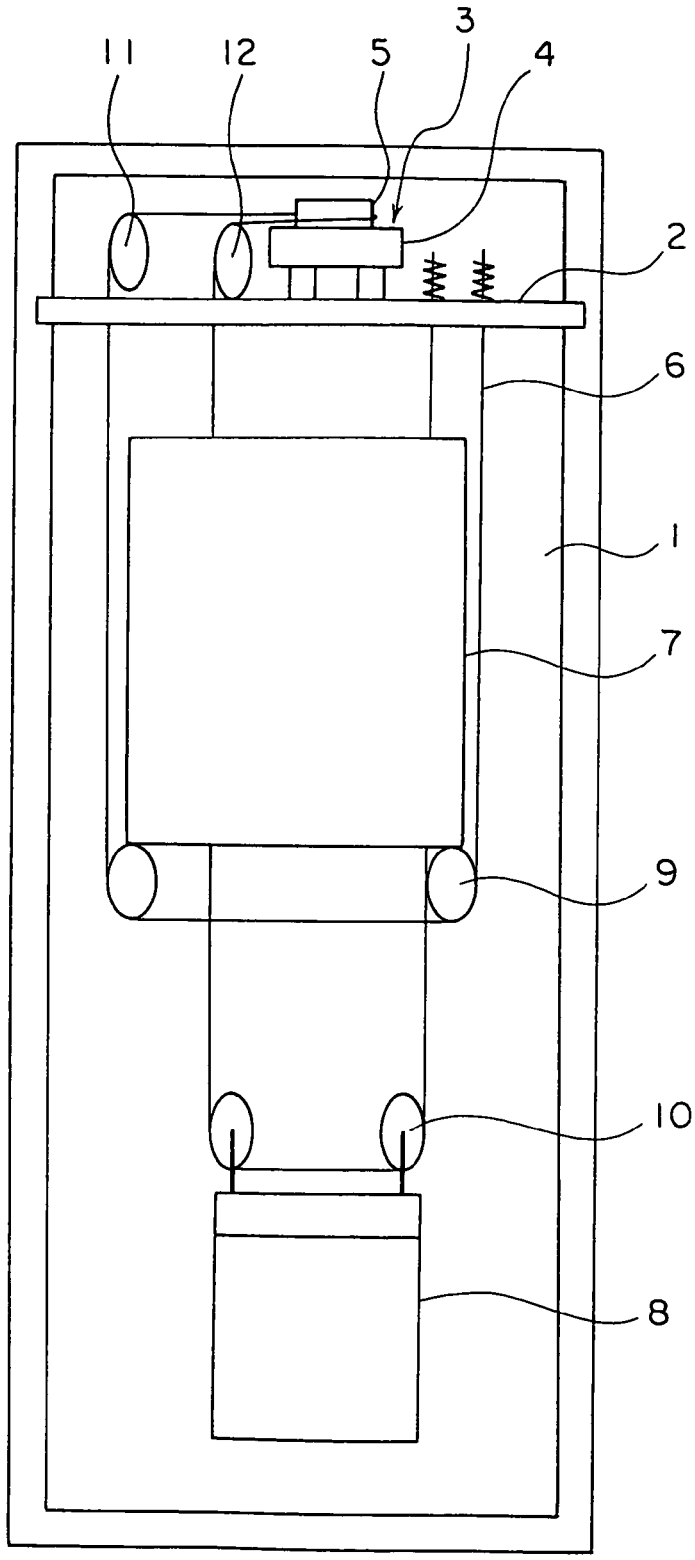
FIG. 1 is a diagram schematically showing the construction of an elevator apparatus according to Embodiment 1 of the present invention.

FIG. 1 is a diagram schematically showing the construction of an elevator apparatus according to Embodiment 1 of the present invention. In the drawing, a support beam 2 is horizontally fixed to the upper portion of the interior of a hoistway 1. A driving machine (hoisting machine) 3 is mounted on the support beam 2. The driving machine 3 has a driving machine main body 4 including a motor, and a driving sheave 5 rotated by the driving machine main body 4. The driving machine 3 is arranged horizontally so that a rotation shaft of the driving sheave 5 may extend vertically.

A plurality of main ropes 6, serving as elevator ropes, are wrapped around the driving sheave 5. For the sake of simplicity, FIG. 1 only shows one main rope 6. The end portions of the main ropes 6 are connected to the support beam 2. A car 7 and a counterweight 8 are suspended in the hoistway 1 by the main ropes 6, and are caused to ascend and descend by the driving machine 3.

Under the car 7, there are provided a pair of car sash pulleys 9 around which the main ropes 6 are wrapped. On top of the counterweight 8, there are provided a pair of counterweight sash pulleys 10 around which the main ropes 6 are wrapped. Mounted on the support beam 2 are a first pulley 11 for guiding the main ropes 6 from the driving sheave 5 to the car sash pulleys 9 and a second pulley 12 for guiding the main ropes 6 from the driving sheave 5 to the counterweight sash pulleys 10.

Figure 2:
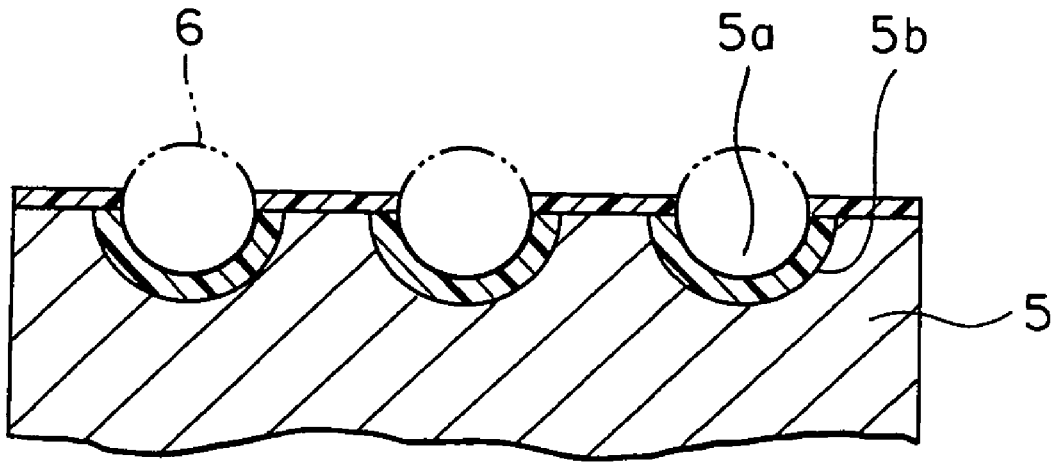
FIG. 2 is a partial sectional view of the driving sheave of FIG. 1.

FIG. 2 is a partial sectional view of the driving sheave 5 of FIG. 1. In the outer peripheral portion of the driving sheave 5, there are formed a plurality of rope grooves 5*a*, into which the main ropes 6 are inserted. The inner peripheral surfaces of the rope grooves 5*a* coming into contact with the main ropes 6 are formed of a resin member 5*b* consisting, for example, of nylon, urethane, or polyethylene. The car sash pulleys 9 and the counterweight sash pulleys 10 have a sectional structure similar to that shown in FIG. 2.

Figure 3:
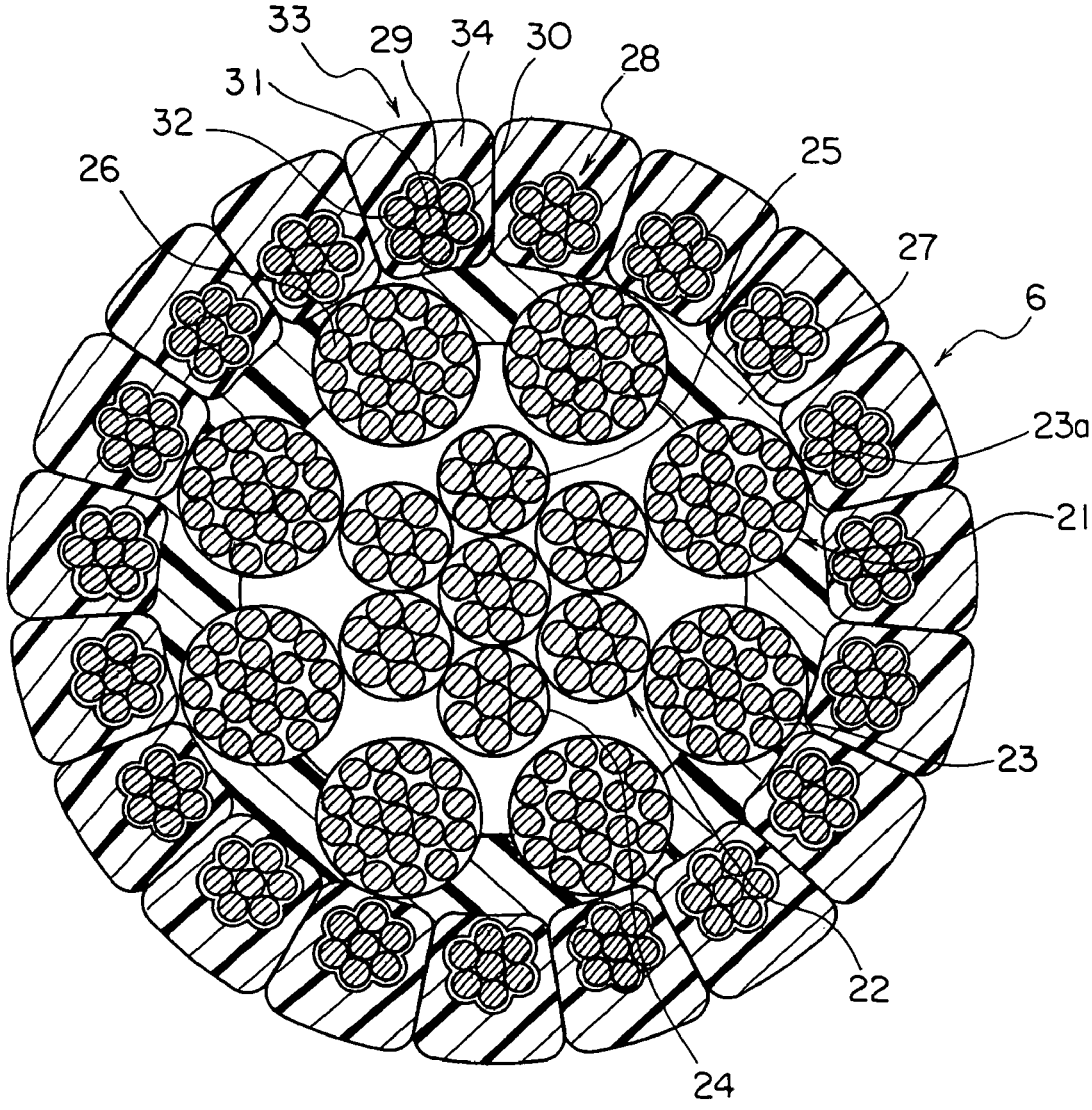
FIG. 3 is a sectional view of the main rope of FIG. 1.
Figure 4:
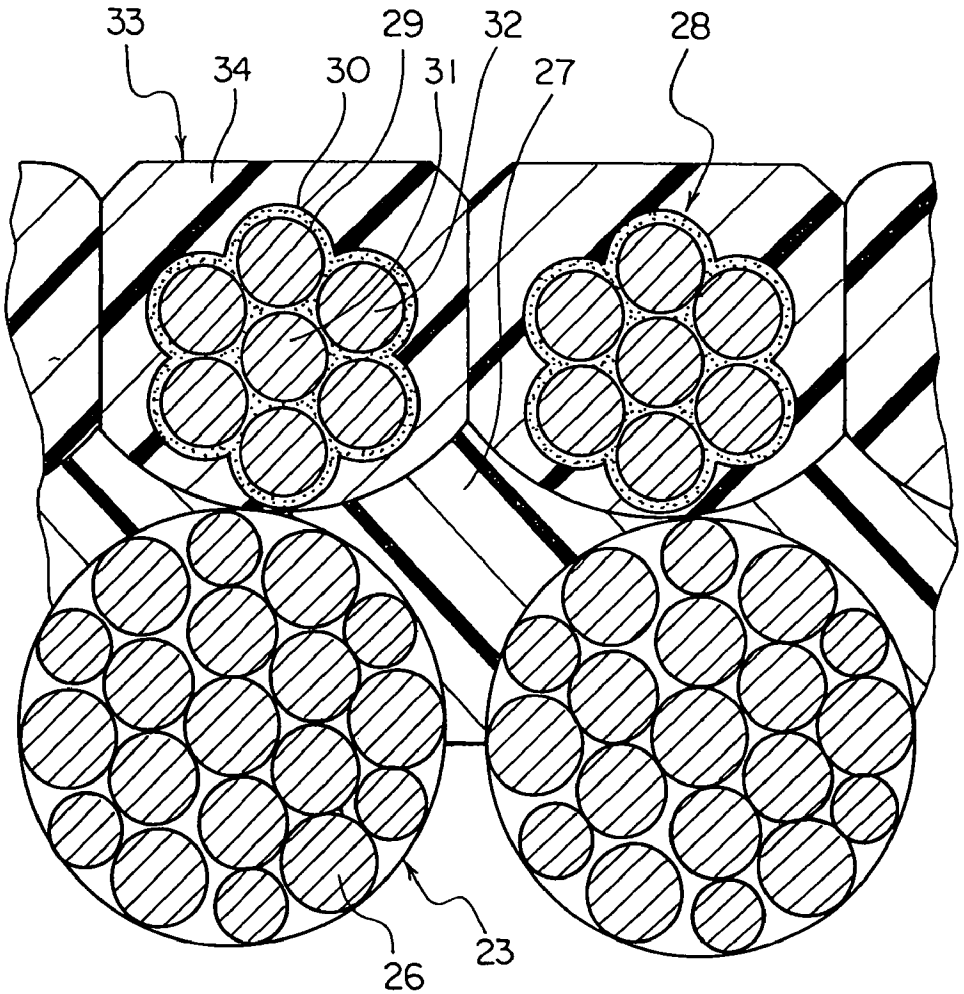
FIG. 4 is an enlarged view of a main portion of FIG. 3.

FIG. 3 is a sectional view of one of the main ropes 6 of FIG. 1, and FIG. 4 is an enlarged view of a main portion of FIG. 3. An inner layer rope 21 has a core rope 22 and a plurality of inner layer strands 23 formed in the outer periphery of the core rope 22. The core rope 22 has a plurality of core strands 24. Each core strand 24 is formed by twisting together a plurality of steel wires 25. The core strands 24 are twisted together, with the inner layer strands 23 and the core strands 24 being twisted in opposite directions.

Each inner layer strand 23 is formed by twisting together a plurality of steel wires 26. The sectional structure of the inner layer strand 23 is that of a Wallington seal type steel core (JIS G 3525). The diameter of the inner layer rope 21 is set as 1/27 or less of that of the driving sheave 5. Further, the inner layer strands 23 and the core strands 25 are partially held in direct contact with each other.

The outer periphery of the inner rope 21 is covered with an inner layer covering body 27 made of resin. The inner layer covering body 27 consists, for example, of a thermoplastic resin, such as polyethylene resin.

An outer layer 28 is provided in the outer periphery of the inner layer covering body 27. The outer layer 28 has a plurality of outer layer strands 29 and a plurality of adhesive layers 30 provided in the outer periphery of the outer layer strands 29. Each outer layer strand 29 is composed of a central wire 31 arranged at the center thereof, and six outer periphery wires 32 arranged in the outer periphery of the central wire 31. Further, the outer layer strands 29 and the inner layer strands 23 are twisted in opposite directions.

The outer periphery of the outer layer 28 is covered with an outer layer covering body 33. The outer layer covering body 33 is formed of a high friction resin material with a coefficient of friction of 0.2 or more, such as polyurethane resin. Further, the outer layer covering body 33 is glued to the outer layer strands 29 through the intermediation of the adhesive layers 30.

The inner layer strands 23 have a plurality of exposed portions 23*a* partially exposed through the outer periphery of the inner layer covering body 27, with the exposed portions 23*a* being in direct contact with the outer layer 28. That is, the inner layer strands 23 and the outer layer 28 are in direct contact with each other in portions where the inner layer strands 23 and the outer layer strands 29 cross each other.

The outer layer covering body 33 has a plurality of unit covering bodies 34 provided for each of the outer layer strands 29 to cover the outer periphery of the outer layer strands 29 and the adhesive layers 30. The outer layer 28 is partially exposed through the unit covering bodies 34 in portions where it is in contact with the exposed portions 23*a*.

The diameter of all the wires 25, 26, 31, and 32 is set as 1/400 or less of that of the driving sheave 5. The diameter of the outer layer strands 29 is set to be smaller than that of the inner layer strands 23.

In this main rope 6, the steel core rope 22 is arranged at the center, and the outer layer strands 29 with a smaller diameter than that of the inner layer strands 23 are arranged in the outer periphery of the core rope 22, so that it is possible to increase the packing density of the steel wires 25, 26, 31, and 32 while restraining an increase in the overall diameter, thus enhancing the strength of the rope.

Further, the inner layer strands 23 and the outer layer strands 29 are twisted in opposite directions, and the inner layer strands 23 and the outer layer 28 are in direct contact with each other where the inner layer strands 23 and the outer layer strands 29 cross each other, so that the inner layer covering body 27 is prevented from being worn between the inner layer strands 23 and the outer layer 28 through repeated bending of the main rope 6, and the strength/load balance of each layer remains unchanged for a long period of time, thus making it possible to maintain a stable strength.

Further, since the outer layer covering body 33 is arranged in the portion of the rope coming into contact with the driving sheave 5, the car sash pulleys 9, the counterweight sash pulleys 10, the first pulley 11, the second pulley 12, etc., it is possible to prevent the outer layer strands 29 from being worn through direct contact with the sheaves.

Furthermore, it is also possible to mitigate the bending stress generated when the wires 31 and 32 of the outer layer strands 29 are crushed, making it possible to elongate the service life of the main rope 6 and to achieve a reduction in sheave diameter.

Further, since the outer layer covering body 33 is arranged on the outermost side, it is also possible to prevent wear on the sheave side and to increase the degree of freedom in terms of material selection for the wires 31 and 32 of the outer layer strands 29 and for the sheaves. Thus, it is possible to further enhance the overall strength and to form the sheaves at low cost.

Further, since the outer layer covering body 33 coming into contact with the driving sheave 5 is formed of a high friction resin material, it is possible to secure a sufficient efficiency in driving force transmission even if the diameter of the driving sheave 5 is diminished.

Here, it is desirable for the high friction resin forming the outer layer covering body 33 to exhibit a coefficient of friction of 0.2 or more, which would make it possible to secure a sufficient efficiency in driving force transmission.

Further, it is desirable that the polyurethane resin, which allows free selection from soft to hard ones, should be a hard polyurethane resin of hardness of 90 degrees or more to secure the requisite wear resistance performance against slight slippage on the sheave surfaces. Further, to prevent hydrolysis that can occur depending on the use environment, it is more desirable to adopt an ether type resin than an ester type one.

Further, by selecting, as the material of the inner layer covering body 27, a material which allows free slippage when the main rope 6 is bent by the sheaves, it is possible to lessen the bending resistance. Furthermore, it is necessary for the inner layer covering body 27 to be hard enough not to be crushed between the wires 26 of the inner layer strands 23 and the wires of the outer layer strands 29. Suitable examples of such a material include a low-friction, hard polyethylene material.

Further, the inner layer covering body 27 does not require a large coefficient of friction as compared with the outer layer covering body 33, and involves less bending due to the sheaves, so that it is not always necessary for its extensibility to be excellent. Thus, it is possible to adopt, as the material of the inner layer covering body 27, a resin, such as nylon, silicon, polypropylene, or polyvinyl chloride. By using such a material for the inner layer covering body 27, it is possible to restrain such a reduction in service life as involved in the case where the steel inner layer rope 21 is used.

Further, each outer layer strand 29 has a simple, seven-wire structure which includes one central wire 31 and six outer periphery wires 32, so that it allows a reduction in the diameter of the main rope 6, and does not easily lose shape, facilitating the covering with the unit covering body 34.

Furthermore, the sectional structure of the inner layer strands 23 is of neither the seal type nor the filler type but the Wallington type, so that no extremely thin wires 26 are used, thereby preventing breakage of the wires 26 due to wear and achieving an increase in service life. Further, for a longer service life, it is preferable to adopt, instead of cross-twisting, parallel twisting for the wires 26 of the inner layer strands 23. In this regard, when the number of wires 26 situated in the outer periphery is the same as or double the number of wires 26 situated on the inner side, it is possible to arrange the wires 26 with ease and in a well-balanced manner, thereby further preventing wear of the wires 26.

Further, by twisting the inner layer strands 23 and the core strands 24 in opposite directions, and twisting the outer layer strands 29 and the inner layer strands 23 in opposite directions, it is possible to achieve a well-balanced inner torque, thus reducing the twist-back torque for the entire rope.

Further, since the inner peripheral surfaces of the rope grooves 5*a* are formed of the resin members 5*b*, it is possible to restrain wear of the outer layer covering bodies 34, and to enhance the efficiency in driving force transmission.

Furthermore, when, as described above, the highly flexible main rope 6 is wrapped around a small diameter sheave, if the outer layer covering body 33 should be damaged, there is a fear of the contact pressure between the sheave and the outer layer strands 29 being increased, resulting in extreme wear of the sheave and the outer layer strands 29.

Thus, in the case of a sheave having a diameter twenty times that of the elevator rope, it is preferable for the number of outer layer strands 29 to be twelve or more (twenty-one in the case shown in FIG. 1). Further, in the case of a sheave having a diameter fifteen times that of the elevator rope, it is preferable for the number of outer layer strands 29 to be sixteen or more.

Due to this arrangement, if the outer layer covering body 33 should be damaged, it is possible to restrain the contact pressure between the sheave and the outer layer strands 29 from increasing, thus restraining wear of the sheave and the outer layer strands 29. Thus, it is not necessary for the material of the sheave to be a particularly expensive one, thus making it possible to form the sheave at low cost.

Further, in the case of a rope having no outer layer covering body 33, the service life is determined by the number of times that tension and bending stress due to the sheave are applied, breakage starting with the wires on the rope surface. In contrast, in the case of a rope using the outer layer covering body 33, the contact pressure between the rope and the sheave is reduced, so that not the wires on the rope surface but the inner ones are more subject to breakage due to bending fatigue.

It has been found through an experiment by the present inventor that the service-life number of times due to this bending fatigue is in a relationship as expressed by the following equations.

Service-Life Calculation Formula

The wires in contact with the sheave suffer breakage when:

$$\text{Service-life number of times } Nc = 10.0 \times k \times 1.05^{D/d}$$

The wires inside the rope suffer breakage when:

$$\text{Service-life number of times } Nn = 19.1 \times k \times 1.05^{D/d}$$

(where k is a coefficient determined by the rope structure and the rope strength)

Here, the value of D/d that makes the service-life number of times Nn equal to the value of Nc when D/d=40 is 26.7. Thus, to secure a service life equivalent to that under the condition applied to an ordinary conventional elevator rope, that is, when D/d=40, it is necessary for the diameter of the inner layer ropes 21 to be 1/27 or less of the diameter of the sheave. In other words, it is necessary to use a sheave having a diameter not less than twenty-seven times the diameter of the inner layer ropes 21.

In the above-described elevator rope, the diameter of all the wires 25, 6, 10, and 11 is set as 1/400 or less of the diameter of the associated sheave, so that the bending-fatigue service life does not suffer if the diameter of the associated sheave is diminished.

Next, a method for manufacturing the main rope 6 will be described. When manufacturing the main rope 6, the inner layer strands 23 are twisted together in the outer periphery of the core rope 22 to thereby prepare the inner layer rope 21. Then, the outer periphery of the inner layer rope 21 is covered with thermoplastic resin to form the inner layer covering body 27.

Figure 5:
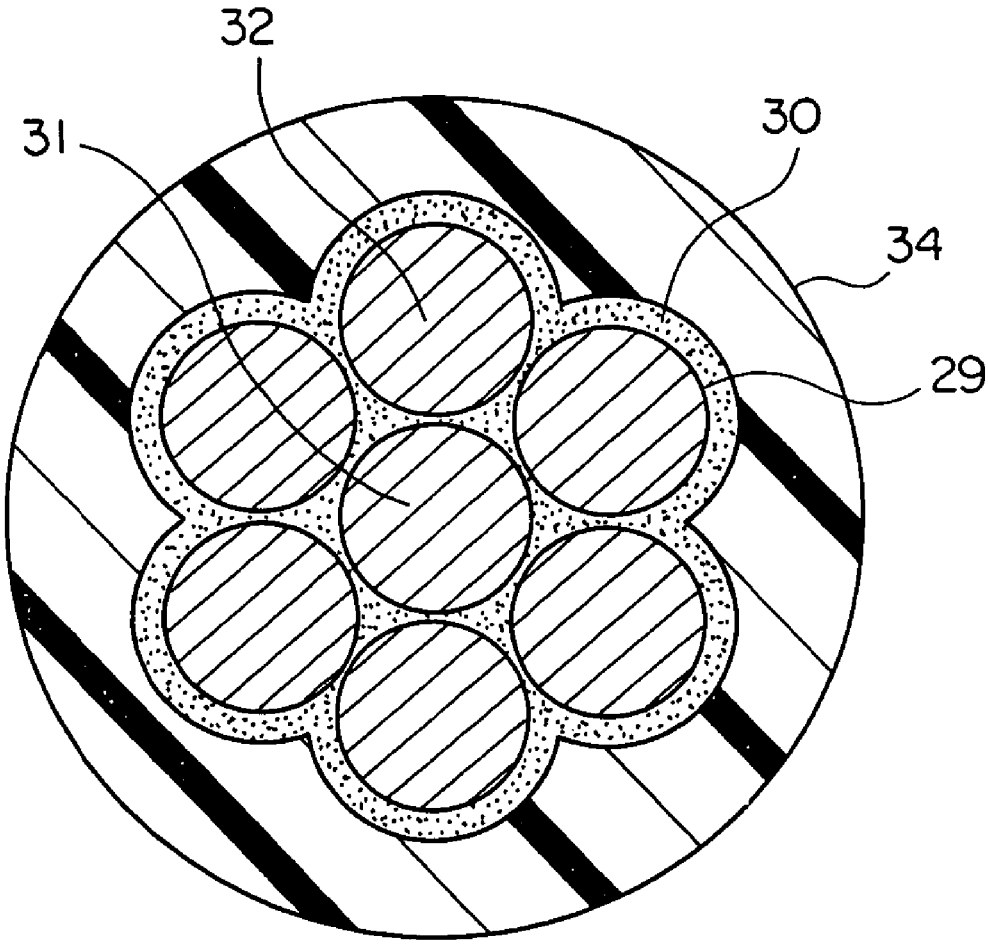
FIG. 5 is a sectional view of an outer layer strand and a unit covering body prior to the arrangement in the outer periphery of the inner layer rope of FIG. 3.

Adhesive is applied to the outer peripheral portions of the outer layer strands 29 to form the adhesive layers 30. The adhesive layer 30 may be applied strand by strand or wire by wire. Then, the outer periphery of the outer layer strands 29 and the adhesive layers 30 is covered with unit covering bodies 34, which are glued to the outer layer strands 29 by the adhesive layer 30. FIG. 5 is a sectional view of the outer layer strand 29 and the unit covering body 34 before they are arranged in the outer periphery of the inner layer rope 21 of FIG. 3.

Thereafter, the outer layer strands 29 covered with the unit covering bodies 34 are twisted in a direction opposite to the twisting direction of the inner layer strands 23 and are arranged in the outer periphery of the inner layer covering body 27, whereby the outer layer 28 is arranged in the outer periphery of the inner covering body 27, and the outer periphery of the outer layer 28 is covered with the outer layer covering body 33.

Further, when arranging the outer layer strands 29 in the outer periphery of the inner layer covering body 27, a tensile force is applied to the inner layer rope 21 and the outer layer strands 29 while heating and softening the inner covering body 27 and the unit covering bodies 34 by, for example, a high-frequency heating device. As a result, the covering bodies 27 and 33 plastically flows into the gaps to be formed into the sectional configuration as shown in FIG. 3. Further, the inner layer strands 23 are partially exposed through the outer periphery of the inner layer covering body 27, and the outer layer 28 is partially exposed through the outer layer covering body 33, thereby bringing the inner layer strands 23 and the outer layer 28 partially into direct contact with each other. Thereafter, the inner layer covering body 23 and the outer layer covering body 33 are cured.

In this manufacturing method, in which a tensile force is applied to the inner layer rope 28 and the outer layer strands 29 while heating and softening the inner layer covering body 27 and the outer layer covering body 33, it is easy for the inner layer strands 23 and the outer layer 28 to partially come into direct contact with each other.

Further, before twisting the outer layer strands 29 in the outer periphery of the inner layer rope 21, the adhesive layer 30 is previously formed in the outer periphery of the outer layer strands 29, so that it is possible to secure a strong adhesion force. Further, it is possible to apply the adhesive layer 30 prior to the twisting of the inner layer rope 21, thereby protecting the outer layer strands 29 from rust.

Further, since the unit covering body 34 is glued for covering each outer layer strand 29, it is possible to secure a stable adhesion strength.

The step of heating and softening the inner layer covering body 27 and the outer layer covering body 33 and applying a tensile force to the inner layer rope 21 and the outer layer strands 29 may be performed after the step of arranging the outer layer strands 29 covered with the unit covering bodies 34 in the outer periphery of the inner layer covering body 27.

Embodiment 2

Figure 6:
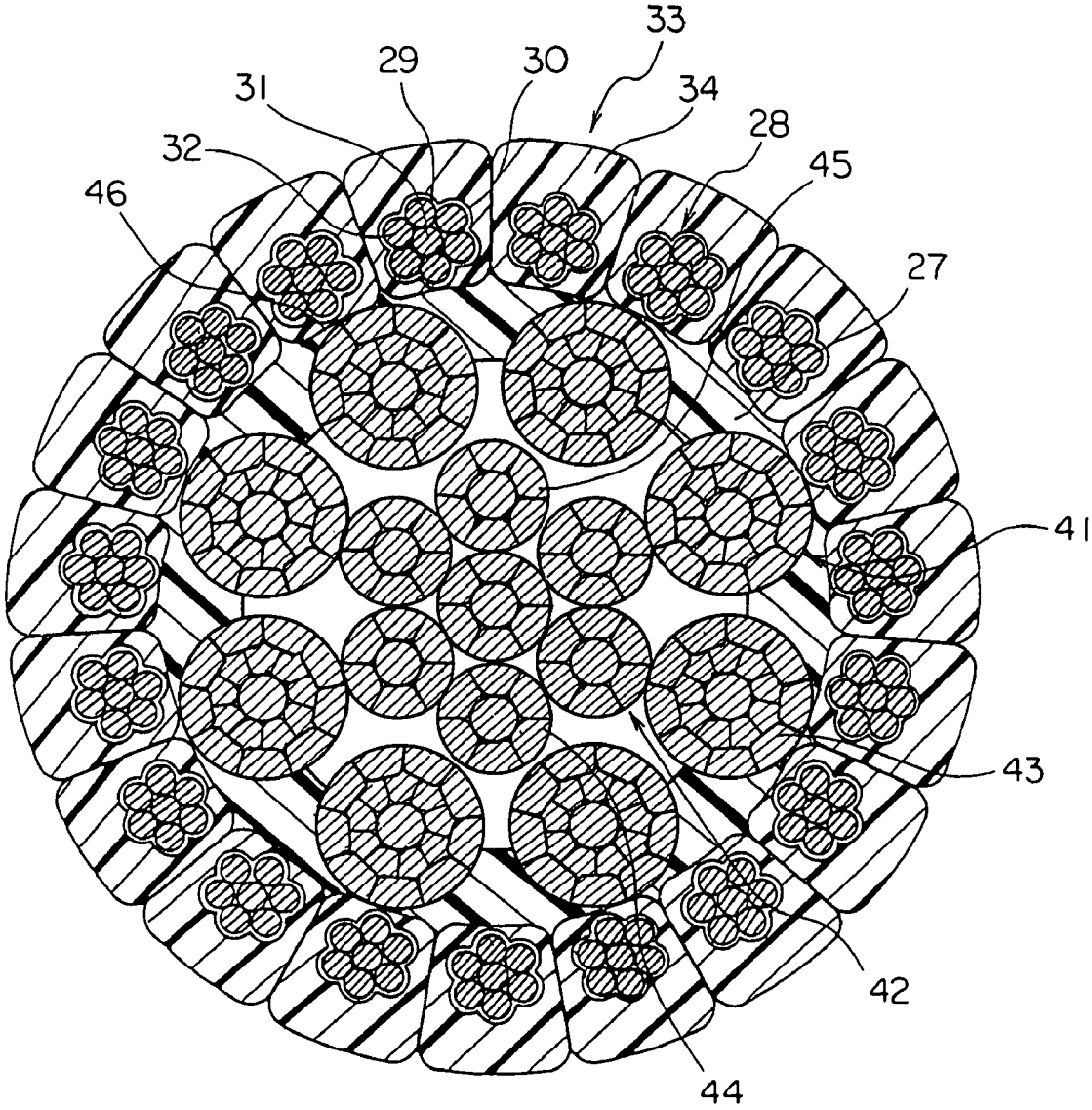
FIG. 6 is a sectional view of an elevator rope according to Embodiment 2 of the present invention.

Next, FIG. 6 is a sectional view of an elevator rope according to Embodiment 2 of the present invention. In the drawing, an inner layer rope 41 has a core rope 42 and a plurality of inner layer strands 43 provided in the outer periphery of the core rope 42. The core rope 42 has a plurality of core strands 44. Each core strand 44 is formed by twisting together a plurality of steel wires 45.

Each inner layer strand 43 is formed by twisting together a plurality of steel wires 46. The sectional configuration of the wires 46 of the inner layer strands 43 is modified through compression of the inner layer strands 43 from the outer periphery. The sectional configuration of the wires 45 of the core strands 44 is modified through compression of the core strands 44 from the outer periphery. Otherwise, this embodiment is of the same construction as Embodiment 1.

In this elevator rope, when manufacturing the inner layer strands 43 and the core strands 44, they are first twisted up in diameters larger than the finish diameters by approximately 5%, and then they are passed through dies of the finish diameters, whereby the wires are brought into not point contact but into face or line contact with each other. This helps to enhance the packing density of the wires 45 and 46. Further, the contact pressure between the wires 45 and between the wires 46 is reduced, thereby restraining wear of the wires 45 and 46. Further, the inner layer strands 43 and the core strands 44 are prevented from losing shape, thereby achieving an increase in service life.

Embodiment 3

Figure 7:
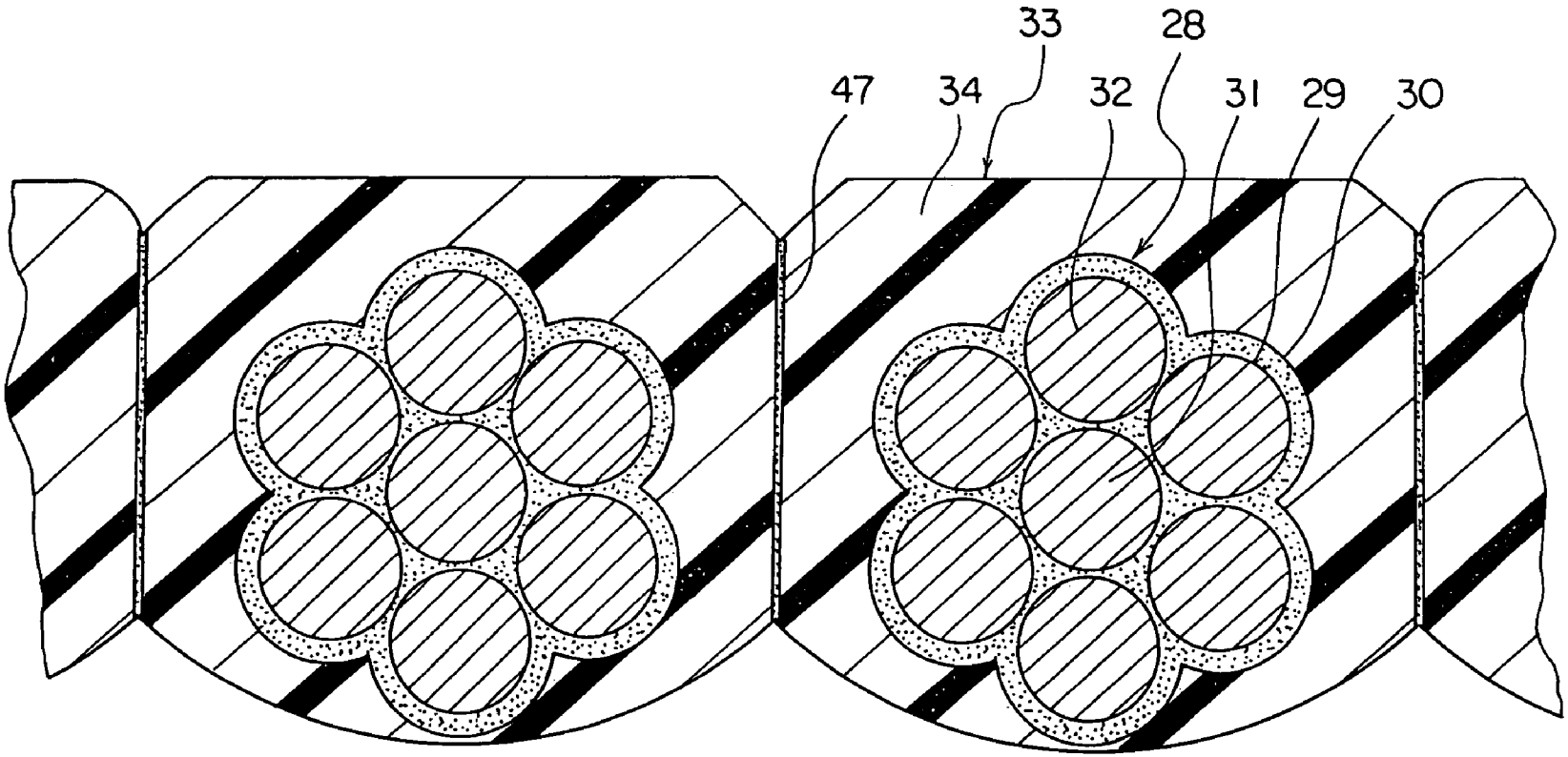
FIG. 7 is a sectional view of a main portion of an elevator rope according to Embodiment 3 of the present invention.

Next, FIG. 7 is a sectional view of a main portion of an elevator rope according to Embodiment 3 of the present invention. In the drawing, the unit covering bodies 34 circumferentially adjacent to each other are connected together through the intermediation of adhesive 47. The adhesive 47 is preferably a rubber type adhesive having characteristics akin to those of the unit covering bodies 34. Otherwise, this embodiment is of the same construction as Embodiment 1.

In this elevator rope, an improvement is achieved in terms of stability in shape with respect to external forces, and it is possible to make the load burden between the outer layer strands 29 uniform, thereby achieving an increase in service life and a stable quality.

Figure 8:
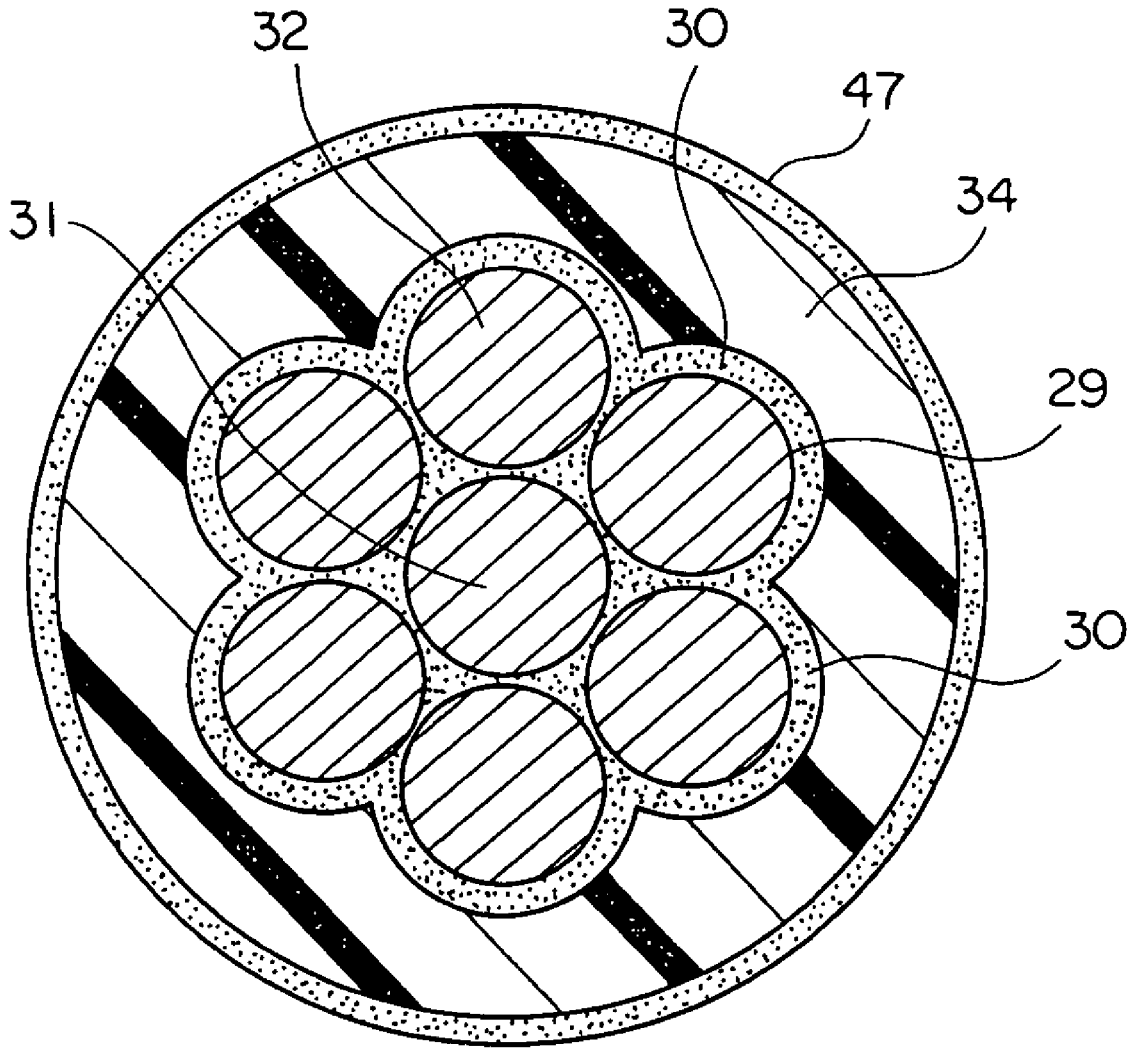
FIG. 8 is a sectional view of the outer layer strand and the unit covering body of FIG. 7 in the course of their manufacturing.

Further, as shown, for example, in FIG. 8, the adhesive 47 may be applied to the outer peripheral portions of the unit covering bodies 34 before arranging the outer layer strands 29 in the outer periphery of the inner layer rope 21 (FIG. 1). Due to this arrangement, it is possible to glue the unit covering bodies 34 to each other in the step of twisting the outer layer strands 29 in the outer periphery of the inner layer rope 21, making it possible to realize high-level quality control in an environment in which the pressure and temperature are controlled in a stable manner. After the mutual adhesion of the unit covering bodies 34, the portion of adhesive 47 adhering to the portions other than the glued portions may be removed, or left as it is if it involves no problem from the practical point of view.

In the multi-layered ropes of Embodiment 1 through 3, the load-carrying rate of each layer is changed due to fatigue from aging. In view of this, though it depends on the rope structure, the load-carrying rate of the layer that is more likely to deteriorate is lessened. That is, the strength of one layer is set as 20 to 80%, and any abnormality in the weakest layer is preferably detected for replacement before the strength of the entire rope markedly deteriorates.

For example, the strength which is the sum total of the strengths of the outer layer strands 29 constituting the weakest layer where the bending stress is maximum, is preferably set to a level within 20% of the strength of the entire elevator rope. This makes it possible to ensure a residual strength of nearly 80% with the inner layer rope 21 alone if the outer layer strands 29 suffer breakage, thus achieving an improvement in terms of reliability.

To realize such a construction, the strength of the wires 31 and 32 of the outer layer strands 29, for example, is set to be lower than the strength of the wires 26 of the inner layer strands 23. More specifically, the strength of the wires 31 and 32 of the outer layer strands 29, for example, is set as 1320 to 2060 $N/mm^2$, and the strength of the wires 26 of the inner layer strands 23 is set as 1910 to 2450 $N/mm^2$.

Further, in this case, when the outer peripheral wires 32 of the outer layer strands 29 are twisted through repulsive twisting, which is free from pre-forming (non-repulsive twisting), the detection of breakage is facilitated. That is, when the outer peripheral wires 32 suffer breakage, the breakage portion is raised to stick out of the outer layer covering body 33. Thus, the breakage of the outer peripheral wires 32 can be visually ascertained, making it possible to more properly judge the service life of the entire rope to thereby achieve an improvement in terms of reliability. Further, since there is no need to use a flaw detector or the like to inspect the breakage state, it is possible to achieve a reduction in maintenance cost.

To promote this rising property, a releasing agent, such as silicone oil, is applied to the surfaces of the unit covering bodies 34, and then the outer layer strands 29 are twisted, thus preventing the unit covering bodies 34 from fusing together.

However, to ensure stability in shape even after generation of breakage, pre-forming is performed on the outer layer strands 29, and the heating temperature for the unit covering bodies 34 is set to a relatively high level, thereby causing the circumferentially adjacent unit covering bodies 34 to fuse together.

The invention claimed is:

1. An elevator rope comprising:

an inner layer rope having a plurality of inner layer strands including a plurality of steel wires twisted together;

an inner layer covering body formed of resin and covering an outer periphery of the inner layer rope;

an outer layer located in an outer periphery of the inner layer covering body and having a plurality of outer layer strands and a plurality of adhesive layers, each of the outer layer strands including a plurality of steel wires twisted together, the adhesive layers being applied to outer peripheral portions of the outer layer strands; and an outer layer covering body formed of a high-friction resin material and glued to the outer layer strands by the adhesive layers, covering an outer periphery of the outer layer, wherein the inner layer strands have a plurality of exposed portions partially exposed through the outer periphery of the inner layer covering body, the exposed portions being in direct contact with the outer layer.

2. The elevator rope according to claim 1, wherein the inner layer strands and the outer layer strands are twisted in opposite directions, and the inner layer strands and the outer layer are in direct contact with each other where the inner layer strands and the outer layer strands cross each other.

3. The elevator rope according to claim 1, wherein the outer layer covering body has a plurality of unit covering bodies, each unit covering body for each of the outer layer strands covering an outer periphery of each of the outer layer strands and the adhesive layers, and the outer layer is partially exposed through the unit covering bodies where the outer layer is in contact with the exposed portions.

4. The elevator rope according to claim 3, including an adhesive wherein the unit covering bodies circumferentially adjacent to each other are connected to each other by the adhesive.

5. The elevator rope according to claim 3, including a releasing agent applied to surfaces of the unit covering bodies.

6. The elevator rope according to claim 3, wherein the unit covering bodies circumferentially adjacent to each other are fused to each other.

7. The elevator rope according to claim 1, wherein a sectional configuration of the wires of the inner layer strands is modified by compressing the inner layer strands from an outer periphery of the inner layer strands.

8. The elevator rope according to claim 7, wherein a sectional structure of the inner layer strands is a sectional structure of a Wallington seal steel core.

9. The elevator rope according to claim 1, wherein the wires of the outer layer strands are twisted by repulsive twisting.

10. An elevator rope according to claim 1, wherein strength of the wires of the outer layer strands is lower than strength of the wires of the inner layer strands.

11. The elevator rope according to claim 10, wherein the strength of the wires of the outer layer strands is 1320 to 2060 $N/mm^2$, and the strength of the wires of the inner layer strands is 1910 to 2450 $N/mm^2$.

12. A method for manufacturing an elevator rope, including:

preparing an inner layer rope by twisting together in a first direction a plurality of inner layer strands, each inner layer strand including a plurality of steel wires;

covering an outer periphery of the inner layer rope with an inner layer covering body of a thermoplastic resin;

twisting a plurality of outer layer strands, each outer layer strand including a plurality of steel wires, in a second direction, opposite the first direction, and arranging the plurality of outer layer strands in an outer periphery of the inner layer covering body, and covering an outer periphery of the outer layer with an outer layer covering body of a high friction resin material;

partially exposing the inner layer strands through an outer periphery of the inner layer strands by applying a tensile force to the inner layer rope and the outer layer strands while heating and softening the inner layer covering body and the outer layer covering body, partially bringing the inner layer strands into direct contact with the outer layer; and curing the inner layer covering body and the outer layer covering body.

13. The method for manufacturing an elevator rope according to claim 12, wherein the outer layer covering body is formed by arranging the outer layer strands in the outer periphery of the inner layer covering body, after covering an outer periphery of each of the outer layer strands with a unit covering body.

14. The method for manufacturing an elevator rope according to claim 13, wherein, when the outer layer strands are arranged in the outer periphery of the inner layer covering body, applying a tensile force to the inner layer rope and the outer layer strands while heating and softening the inner layer covering body and the unit covering body.

* * * * *